US009347315B2

(12) United States Patent
Müller et al.

(10) Patent No.: US 9,347,315 B2
(45) Date of Patent: May 24, 2016

(54) DEVICE MACHINING MATERIALS BY MILLING OR DRILLING, AND METHOD THEREFOR

(71) Applicant: Caterpillar Global Mining Europe GmbH, Lünen (DE)

(72) Inventors: Martin Müller, Unterlunkhofen (CH); Roland Anderegg, Olten (CH); Lukas Kurmann, Franken (FR)

(73) Assignee: Caterpillar Global Mining Europe GmbH, Lünen (DE)

( * ) Notice: Subject to any disclaimer, the term of this patent is extended or adjusted under 35 U.S.C. 154(b) by 0 days.

(21) Appl. No.: 14/346,627

(22) PCT Filed: Sep. 25, 2012

(86) PCT No.: PCT/US2012/056977

§ 371 (c)(1),
(2) Date: Mar. 21, 2014

(87) PCT Pub. No.: WO2013/048974

PCT Pub. Date: Apr. 4, 2013

(65) Prior Publication Data

US 2014/0232168 A1 Aug. 21, 2014

(30) Foreign Application Priority Data

Sep. 27, 2011 (DE) ..... 10 2011 053 984

(51) Int. Cl.
*E21C 27/22* (2006.01)
*E21C 27/24* (2006.01)
(Continued)

(52) U.S. Cl.
CPC . *E21C 25/06* (2013.01); *B28D 1/18* (2013.01); *E21C 27/22* (2013.01); *E21C 27/24* (2013.01); *E21C 31/02* (2013.01); *E21C 35/24* (2013.01); *E21C 41/16* (2013.01)

(58) Field of Classification Search
CPC ..... E21C 27/22; E21C 27/24; E21C 35/24; E21C 31/02
See application file for complete search history.

(56) References Cited

U.S. PATENT DOCUMENTS 4,515,409 A * 5/1985 Parrott ..... 299/43
4,591,209 A 5/1986 Droscher et al.
(Continued)

FOREIGN PATENT DOCUMENTS

| | | |
|---|---|---|
| CN | 201396157 | 2/2010 |
| EP | 1841949 | 8/2010 |
| WO | WO 2008/025555 | 3/2008 |

OTHER PUBLICATIONS

International Search Report for PCT/US2012/056977, mailing date Feb. 21, 2013, 4 pages.

*Primary Examiner* — David Bagnell
*Assistant Examiner* — Michael Goodwin

(57) ABSTRACT

A method and device for machining materials includes a tool drum having tool shafts that support machining tools that can be driven in rotation. A drive element rotates the tool shafts and the tool drum relative to each other, and a drum carrier can be moved relative to the material by using a movement device. A control device varies the speed of the relative movement between the tool carrier and material and the rotational speed of the tool drum. To avoid critical operating points, one measuring sensor measures the natural translational vibration and/or another measuring sensor determines the rotational vibrations of the tool drum. The control device has a vibration analysis module, by which a vibration spectrum can be determined, and at least one controller module, by which drive parameters can be controlled as a function of the vibrations determined by the analysis module.

16 Claims, 3 Drawing Sheets

(51) Int. Cl.

| | |
|---|---|
| ***E21C 31/02*** | (2006.01) |
| ***E21C 25/06*** | (2006.01) |
| ***B28D 1/18*** | (2006.01) |
| ***E21C 35/24*** | (2006.01) |
| ***E21C 41/16*** | (2006.01) |

(56) References Cited

U.S. PATENT DOCUMENTS

| | | | | |
|---|---|---|---|---|
| 4,741,577 | A | 5/1988 | Sato et al. | |
| 4,976,495 | A | 12/1990 | Lewins et al. | |
| 4,993,779 | A * | 2/1991 | Cocksedge | 299/43 |
| 6,062,650 | A * | 5/2000 | Smith et al. | 299/1.4 |
| 6,857,706 | B2 | 2/2005 | Hames et al. | |
| 8,393,687 | B2 * | 3/2013 | Powell | 299/42 |
| 2003/0173819 | A1 | 9/2003 | Hames et al. | |
| 2008/0153402 | A1 * | 6/2008 | Arcona et al. | 451/352 |
| 2010/0001574 | A1 | 1/2010 | Bechem | |
| 2010/0063691 | A1 * | 3/2010 | Hall et al. | 701/50 |
| 2010/0132443 | A1 * | 6/2010 | Kim et al. | 73/114.63 |
| 2011/0001348 | A1 * | 1/2011 | Junker et al. | 299/1.6 |
| 2011/0204636 | A1 * | 8/2011 | Scholte-Wassink et al. | 290/44 |

* cited by examiner

DEVICE MACHINING MATERIALS BY MILLING OR DRILLING, AND METHOD THEREFOR

CROSS-REFERENCE TO RELATED APPLICATIONS

This application claims the benefit of priority to international patent application number PCT/US2012/056977, having a filing date of Sep. 25, 2012, which claims the benefit of priority to German Patent Application Number 102011053984.0, having a filing date of Sep. 27, 2011, the complete disclosures of which are hereby incorporated by reference for all purposes.

TECHNICAL FIELD

The invention relates to a device for machining materials by milling and/or drilling, in particular for removing rock, concrete, minerals or coal, having a tool drum which is mounted on a drum carrier such that it can rotate about a drum axis and in which a plurality of tool shafts which bear machining tools at their ends projecting from the tool drum are mounted such that they can be driven in rotation, it being possible for at least two tool shafts to be driven by a common gear drive, which has output drive gears rotationally fixedly arranged on the tool shafts and a common drive element which interacts with the output drive gears, the drive element and the tool drum being rotatable relative to each other, having a movement device for moving the drum carrier relative to the material to be machined, and having a control device with which the speed of the relative movement between tool carrier and material and the rotational speed of the tool drum can be varied. The invention also relates to a method for machining materials by milling and/or drilling, in particular for removing rock, minerals or coal, by means of a device which has a tool drum which is mounted on a drum carrier and rotates about a drum axis, in which a plurality of tool shafts driven in rotation by a drive element of a common gear drive are mounted, bearing machining tools at their ends projecting from the tool drum, the tool shafts rotating at a first rotational speed and the tool drum rotating at a second rotational speed, the tool carrier being moved relative to a material to be machined by means of a movement device, and the speed of the relative movement between tool carrier and material and the rotational speed of the tool drum and/or the tool shafts being varied by means of a control device.

BACKGROUND

Devices of the generic type, on which the aforementioned method can be carried out, are known, for example from EP 1 841 949 B1 and also WO 2008/025555 A1. By using the devices of the generic type, even materials that are otherwise difficult to machine, such as concrete, but also other hard materials such as iron ores and the like, can be removed at a high milling rate. Depending on the machine parameters chosen, such as the rotational speed of the tool drums, the transmission ratio, the material to be removed and the material of the tools used, different removal rates and different service lives of the device are manifested. Observations during operation have shown that, in some operating states, higher removal rates can be achieved with less wear than if other operating parameters are chosen and that, at the same time, there exist critical operating parameters under which damage to the device and/or the tools can occur.

SUMMARY

The object of the disclosure is to improve the device in such a way that corresponding critical operating points do not occur or are avoided and/or the device can be employed with optimized operating parameters, and also to specify a method as to how a corresponding device should be operated for this objective.

In order to achieve this object, the disclosure proposes that the device be assigned at least one measuring sensor for measuring the translational vibration of the device and/or at least one measuring sensor for determining the rotational vibration of the tool drum, the control device comprising at least one vibration analysis module, by means of which, in a vibration analysis for the vibration(s) determined, a vibration spectrum can be determined, and comprising at least one controller module by means of which the rotational speed and/or the relative speed can be or are controlled as a function of the vibrations determined by the analysis module. The applicant believes that both the interaction between the respective tool and the material to be removed and also the dynamics resulting from the mechanical construction of the device, in particular from the superimposition of the rotating tool drum and the movement of the machining tools and tool shafts superimposed on this rotation, have to be taken into account. In order to be able to build up a suitable measurement and control concept on the basis of these factors, the natural translational vibrations of the device and/or the rotational vibrations of the tool drum are registered by measurement, evaluated in a suitable vibration analysis and, by using the vibration analysis and from the vibration spectrum, drive parameters for the rotational speed or the relative speed are derived, preferably via a controller module or via a plurality of controller modules. For this purpose, the vibration analysis module and the controller module can in particular include software routines within the control device, with which the frequency spectrum established and measured is evaluated, preferably in real time, in order then to trim the device for an improved operational behaviour via the aforementioned machine parameters, specifically the rotational speed and/or the relative speed.

According to one possible structure, the device can have a tool drum with a drum drive which is decoupled from the gear drive for the tool shafts, in this configuration of the device, the rotational speed ratio then being variable by means of the control device as an additional control parameter. However, the device can also have a structure in which the tool drum and tool shafts are coupled and have a common rotational drive, consequently the tool drum forming the sun wheel and the tool shafts forming the associated planets. In the case of a device with a fixed rotational speed ratio between the tool drum rotational speed and the tool shafts rotational speed, this frequency ratio forms a device-specific fixed variable which, although it can be set optimally in the factory for a subsequent operating behaviour, cannot be varied during continuous operation.

The vibration analysis module can in particular use an FFT algorithm. Alternatively, the vibration analysis module can use a wavelet transformation, for example, since a suitable image of frequency and time can always be analysed in a relatively fast transformation via wavelets.

According to an advantageous refinement of the device, the movement device can comprise a pivoting arm and the pivoting speed of the pivoting arm can be varied as a control parameter. Alternatively, the movement device can comprise a lantern gear or a rack and at least one gear meshing therewith, and the rotational speed of the gear can be varied as a control parameter.

The drum drive and/or the gear drive preferably comprise continuously controllable drives.

In addition to a basic vibration or excitation frequency, as a rule the vibration spectrum also exhibits or comprises harmonics of the excitation frequency and sub-harmonic vibrations of the excitation frequency. According to an advantageous control concept, the rotational speed and/or the relative speed can be or are controlled in such a way that harmonics have a defined relationship with respect to the basic vibration. In this regard, vibration analyses have shown that the rotational vibrations are usually greater by a factor of 10 than the translational vibrations. By means of suitable trimming of the kinematics of the device, the harmonics determined in the vibration analysis can subsequently be controlled in such a way that only specific frequencies or orders of harmonics occur. In order to intensify the removal effect, however, the control can also be carried out in such a way that the further harmonics have an intensifying effect. According to another control concept, sub-harmonic vibrations can be or are determined from the vibration analysis and vibration spectrum, or the rotational speed and/or the relative speed can be or are controlled in such a way that the sub-harmonic vibrations assume a specific desired value in relation to the basic vibration. According to a still further alternative control concept, non-linear sub-harmonic vibrations can be or are determined from the vibration analysis, and the control device is assigned a controller module with which the speed of the movement device or a material penetration depth can be controlled in such a way that the sub-harmonic vibrations reach a desired value. The respective control concept can also depend on whether the intention is to achieve the highest possible removal performance or else lower-wear demolition and therefore a long service life. By means of trimming the device into a stable vibration behaviour whilst taking the harmonics and/or sub-harmonics into account, the efficiency of the removal process can be increased significantly, above all the non-linear operating behaviour of the device can be optimized, since it is precisely as a result of this non-linear operating behaviour that increased loading of the device with a reduced demolition performance would occur. The machine control parameters, in particular rotational speed and feed speed and, if appropriate, also cutting depths, can in particular be changed in accordance with a configured time.

The measuring sensors for the natural translational vibrations can comprise an acceleration sensor, in particular a three-axis acceleration sensor. The measuring sensor used for determining the rotational vibrations can be a direct-measuring absolute encoder assigned to the tool drum, in particular an inductive sensor, or the tool drum, or a component rotationally fixedly coupled to the latter can be assigned, for example, a Hall sensor. The measuring sensor for determining the rotational vibrations can also comprise torque sensors assigned to the tool shafts.

The aforementioned object is achieved in terms of the method in that, by means of a measuring sensor, the translational vibrations of the device are measured and/or, by means of a measuring sensor, the rotational movements of the tool drum are determined, a vibration spectrum being formed or determined by means of a vibration analysis for the vibration determined or the vibrations determined, and the rotational speed and/or the relative speed being controlled as a function of the vibrations determined by using the analysis module. The control can be carried out in such a way that the rotational speed and/or the relative speed are controlled in such a way that harmonics, which in each case can be determined by the vibration spectrum, reach a desired value in relation to the basic vibration. Alternatively or additionally, the control can be carried out in such a way that sub-harmonic vibrations are determined from the vibration analysis or the vibration spectrum, and the rotational speed and/or the relative speed are controlled in such a way that these sub-harmonic vibrations reach a desired value in relation to the basic vibration or, alternatively, sub-harmonic vibrations are determined from the vibration analysis and the control device is assigned a controller module with which the speed of the movement device or a material penetration depth is controlled in such a way that the sub-harmonic vibrations are optimized.

Further advantages and refinements of the invention can be gathered from the following description of an exemplary embodiment shown schematically in the drawings.

DETAILED DESCRIPTION

Figure 1:
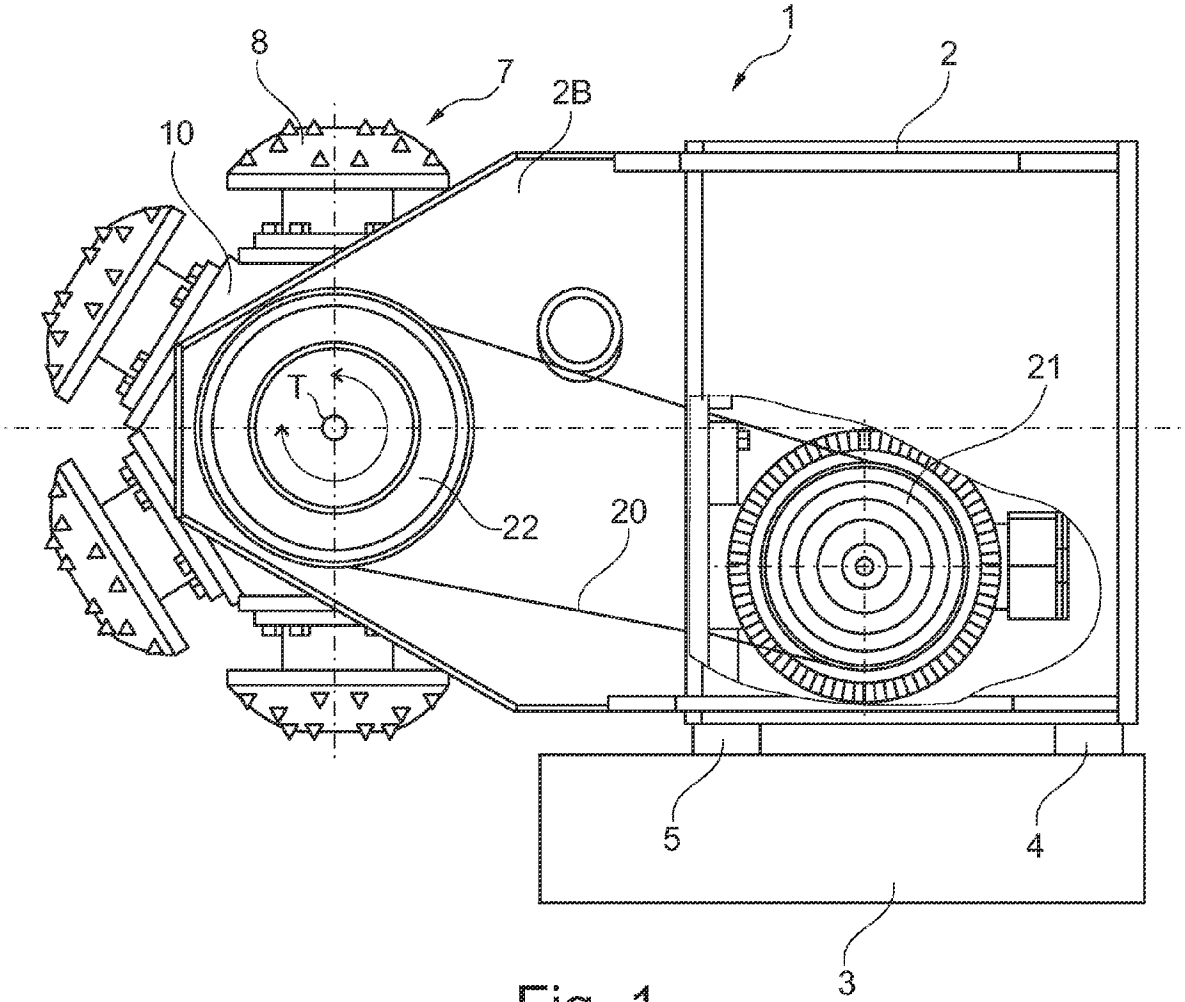
FIG. 1 shows, schematically in side view, a device according to the invention that can be moved linearly along a lantern gear.
Figure 2:
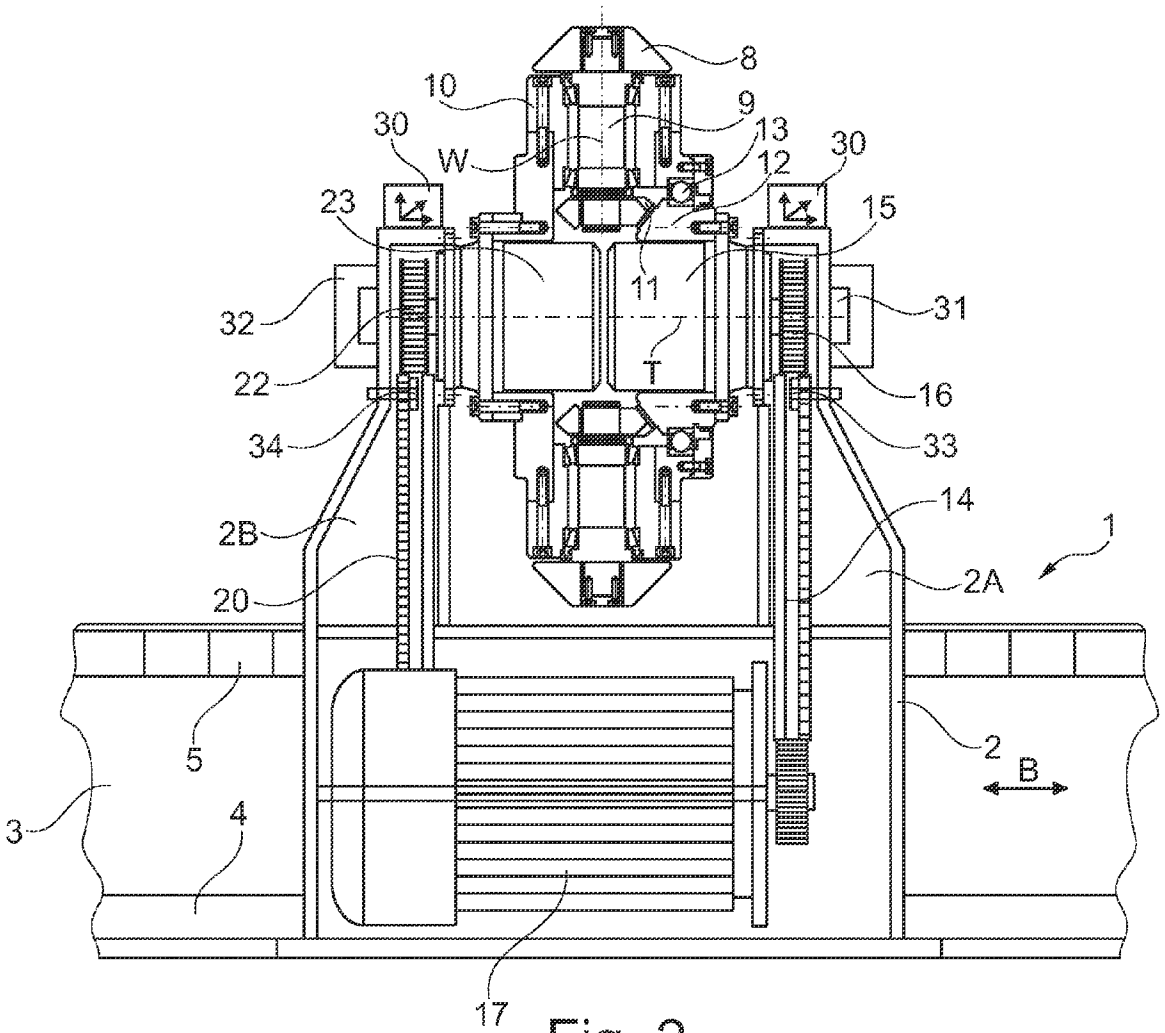
FIG. 2 shows, schematically in a plan view of the device from FIG. 1, the internal structure thereof and the arrangement of measuring sensors.

FIGS. 1 and 2 show, schematically in highly simplified form and only for the basic illustration of the embodiment of the disclosure, a device designated overall by reference symbol 1, having a casing 2 which is arranged along a rack or lantern gear arrangement 3 which, in addition to machine guides 4, also has a rack 5, with which a gear (reference symbol 6, only shown in FIG. 3) meshes, as a linear drive for moving the device 2. Via the lantern gear arrangement 3 and the gear 6, driven by means of a suitable motor, the device 2 can be moved at different speeds parallel to a material to be removed, for example a mineral rock face or coal face to be removed, but also parallel to a concrete wall or the like. The removal of the material is carried out by means of individual tools 7 which, distributed circumferentially in a plurality of rows, are arranged on tool heads 8, which are mounted on a tool drum 10 via the tool shafts 9 shown in FIG. 2. The tool drum 10 in the exemplary embodiment shown has a drum axis T which here is parallel to the direction of movement of the device 1, indicated in FIG. 2 by the arrow B. Arranged on the circumference of the drum 10 in the exemplary embodiment shown are six tool shafts 9 with associated tool heads 8, the shaft axes W of the individual tool shafts 9 being perpendicular to the drum axis T in the exemplary embodiment shown. In order to support the rotatable tool drum 10 on the casing 2 of the device, the casing 2 is provided with a cantilever arm 2A, 2B respectively on both sides of the tool drum 10.

In the exemplary embodiment shown, each tool shaft 9 is connected at its end located opposite the tool head 8 in the interior of the tool drum 10 to an output drive gear 11, which meshes with a further gear 12 as a common drive element for all the tool shafts 9. The gear 12, as drive element, can be rotated relative to the tool drum 10 on account of the rotatable mounting by means of the bearings 13, and the drive gear 12 in the exemplary embodiment shown can be driven by the drive 17 via a toothed belt 14, which engages with a first belt pulley 16 fixed to the input, for example, of a gear hub 15. Furthermore, the tool drum 10 can also be driven via a second gear 20 and a drum drive 21 located behind the drive 17 but hidden in FIG. 2, as shown in FIG. 1, for which purpose in turn a further belt pulley 22 is fixed to the input side of a second gear hub 23. The two gear hubs 15 and 23 can also comprise other gearbox modules, in order to drive the tool shaft 9 via the drive 17 and the tool drum 10 via the drive 21 respectively, independently of one another. The basic structure of the device is also described, for example, in the international patent application WO 2008/025555 A1 from the applicant, the disclosure content of which is hereby incorporated by reference in its entirety. Since, without departing from the invention, the internal structure of the device or of the drum could also be such that the tool shafts protrude obliquely with respect to the drum axis and/or the movement of the entire device could be carried out at right angles to the drum axis, as described in WO 2008/025555 A1, rather than parallel to the drum axis, reference is also additionally made in this connection to the disclosure there.

In order to achieve an improved operating behaviour on the device 1 and to be able to implement appropriate drive methods for the device 1, in the exemplary embodiment in each case a measuring sensor 30 for measuring the translational vibrations in the device 1 is arranged on the supporting arms 2A, 2B, the measuring sensors 30 preferably consisting of three-dimensional acceleration sensors. The gear drive (14, 15, 16, 17) for the tool shaft 9 is assigned a measuring sensor 31 for the absolute rotational speed, for example of the belt pulley 16, and the gear drive (20, 21, 22, 23) of the tool drum 10 is assigned a measuring sensor 32 as an absolute encoder for the rotational speed of the belt pulley 22. The belt pulley 16 for the tool shaft 9 is additionally assigned a measuring sensor 32, for example a Hall sensor, and/or the toothed belt pulley 22 is assigned a further measuring sensor 34, for example a Hall sensor once more, it being possible for the rotational vibrations of the toothed belt pulley 16 for the tool shaft 9 to be determined via the measuring sensor systems 31, 33 and for the rotational vibrations for the tool drum 10 to be determined via the measuring sensor system 32, 34. Instead of Hall sensors, inductive sensors and other sensors could also be used for determining the rotational vibrations.

Figure 3:
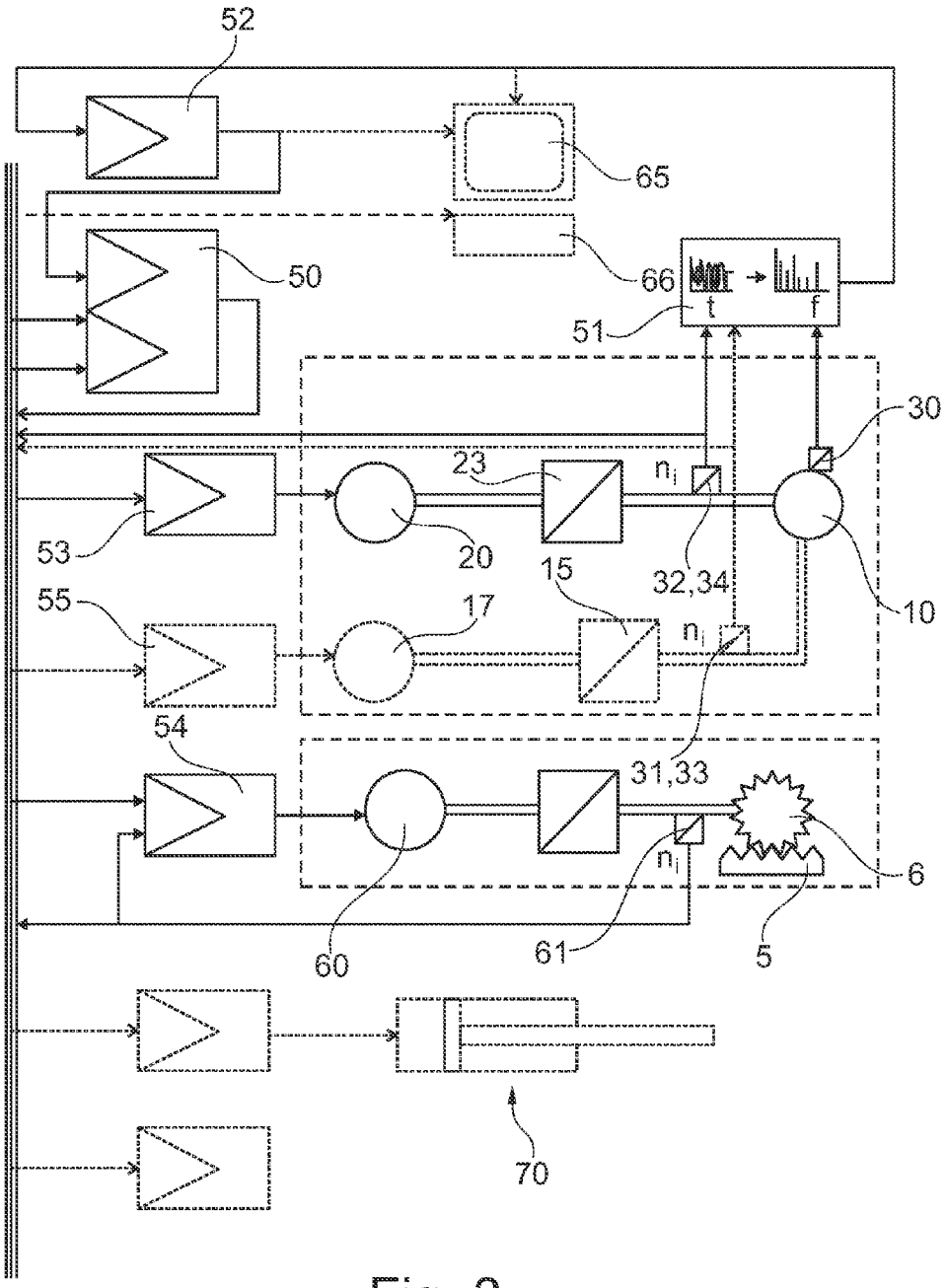
FIG. 3 uses a control diagram to show the control possibilities for the device according to FIGS. 1 and 2.

Reference will now be made to FIG. 3, in which, by using a schematic drawing, the control concept of the device according to FIGS. 1 and 2 is explained. If, in the schematic drawing, measuring sensors or components according to FIGS. 1 and 2 are indicated, the same reference symbols are used in the schematic drawing 3 as in FIGS. 1 and 2. This applies, for example, to the rack 5, the associated drive gear 6 meshing herewith, the tool drum 10, the associated gearboxes 15, 23 and motors 17, 20.

In order to drive the device, the device is assigned a machine control system 50 as a control device to which, for example, the values measured by the rotational speed and rotational vibration sensors 32, 34 for the tool drum 10 are fed back. The same is also true of the measured values from the measuring sensors 31, 33. The rotational vibrations determined by the sensor systems 32, 34 and 31, 33 are fed to a vibration analysis module 51, which is preferably implemented using software within the machine control system, and there, by means of suitable frequency analysis methods such as a classical FFT frequency analysis or wavelet transformation, the respective vibration spectrum is determined and evaluated with regard to basic vibrations, harmonics, sub-harmonic vibrations, period doublings, vibration amplitudes, etc. The vibration analysis module 51 is also supplied with the measured values from the measuring sensors 30 for measuring the natural translational vibrations of the device and, via a suitable controller module 52, which once more can preferably consist of suitable software routines, control parameters and drive parameters are defined in the machine control system 50 from the characteristic values determined by means of the vibration measurement of the natural translational vibration and the rotational vibration. By using the vibrations determined, such as a basic vibration, for example having an excitation frequency f, by using harmonics having integer multiples of the excitation frequency f (consequently 2f, 3f, . . . ) and/or by using sub-harmonic vibrations, for example having the frequencies f/2, f/3, f/4, . . . of the excitation frequency, these being determined with the vibration analysis module 51 by using the vibration spectrum, and a controller 52 connected downstream of the said module, for example via a controller or a frequency converter 53, the machine control system 50 controls the drive rotational speed of the drive 20 for the tool drum 10 and/or, via a controller 54, the relative speed of the entire device 1 relative to the material to be removed, by the drive parameters of the motor 60 for the drive gear 6 being varied via the controller 54. Here, the absolute drive rotational speed of the drive gear 6 can once more be determined by means of a further measuring sensor 61 and fed back to the machine control system 50 as a control variable.

If, as in the exemplary embodiment shown, the rotational speed of the tool shafts can be driven separately from the rotational speed of the tool drum 10, the overall control concept comprises a further controller or frequency converter 55, which is assigned to the drive 17 for the tool shafts 9, the rotational vibrations of this drive train also being supplied to the vibration analysis module 51 via the measuring sensor system 31, 33. For the purpose of visualization, a monitor 65 can be provided and, in order to record and evaluate the individual values from the controllers and modules, a display and recording device 66 can be provided.

The controller concept and the drive methods that can be implemented herewith for an appropriate device can be expanded for other devices or demolition methods. The entire device can, for example, additionally have a feed device 70 with which, for example, the entire device can be pivoted vertically or else the cutting depth can be adjusted as an additional control parameter.

The measurement and control system can, for example, implement a process sequence such that, with the aid of the machine parameters for the speed of movement of the device, with the aid of the rotational speed for the tool shafts and with the aid of the rotational speed of the tool drum 10, the kinematics of the entire device are trimmed in such a way that the harmonics determined in the frequency analysis decrease. For this purpose, to a first approximation, the ratio of the frequencies between the tool drum 10 and the tool shafts 9 and then the ratio of the speed of movement to one of the two rotational speed frequencies can be adjusted. Via one of the controller modules, the driving can then be carried out in such a way that all the non-linearities are optimized and, for example, minimized for this purpose, which means that no sub-harmonic oscillations occur, the occurrence of corresponding sub-harmonic vibrations being determined continuously during the running working operation via the vibration analysis. In order to avoid overloads, for example the cutting depth could also be varied in limiting situations.

The device and the method according to the invention are not restricted to the preceding exemplary embodiment. The overall device could also work with a single drive for tool drum and tool shafts, so that the tool drum would then be constructed in the manner of a sun wheel and the tool shafts would be in a fixed rotational speed relationship with the sun wheel. However, it is important that, in the demolition method, a superimposed rotation of the tool drum and a rotation of the tool shafts bearing the tools is carried out, and the vibrations resulting from this superimposed function can be used as drive parameters for the adjustable machine variables.

The invention claimed is:

1. A device for machining materials by milling and/or drilling, comprising:

a tool drum mounted on a drum carrier, the tool drum being rotatable about a drum axis and having a plurality of rotatable drivable tool shafts mounted therein, the tool shafts bearing machining tools at their ends projecting from the tool drum, at least two of the tool shafts being drivable by a common gear drive having output drive gears rotationally fixedly arranged on the tool shafts and a common drive element interacting with the output drive gears;

wherein the common drive element and the tool drum are rotatable relative to each other;

a movement device configured to move the drum carrier relative to the material to be machined;

a control device configured to control a relative speed of the movement between the drum carrier and the material to be machined, and a rotational speed of the tool drum;

at least one measuring sensor for measuring translational vibrations of the device and/or at least one measuring sensor for measuring rotational vibrations of the tool drum; and wherein the control device comprises:

at least one vibration analysis module configured to determine, via a vibration analysis, a vibration spectrum; and at least one controller module configured to control the rotational speed and/or the relative speed based on the vibration spectrum such that a ratio between harmonics determined by the vibration analysis and a basic vibration is maintained at a predetermined value.

2. The device according to claim 1, wherein the tool drum has a drum drive decoupled from the gear drive for the tool shafts, and wherein the control device is configured to control a rotational speed ratio between a rotational speed of the gear drive and a rotational speed of the drum drive.

3. The device according to claim 1, wherein the tool drum and the tool shafts have a common rotational drive.

4. The device according to claim 1, wherein the vibration analysis module uses a Fast Fourier Transform (FFT) algorithm.

5. The device according to claim 1, wherein the vibration analysis module uses a wavelet transformation.

6. The device according to claim 1, wherein the movement device comprises a lantern gear or a rack and at least one gear meshing therewith, and the rotational speed of the at least one gear is variable as a control parameter.

7. The device according to claim 1, wherein a drum drive and the gear drive comprise continuously controllable drives.

8. The device according to claim 1, wherein sub-harmonic vibrations are determinable from the vibration analysis, and the rotational speed and/or the relative speed are controllable such that the sub-harmonic vibrations reach a predetermined value in relation to the basic vibration.

9. The device according to claim 1, wherein sub-harmonic vibrations are determinable from the vibration analysis, and the control device is configured to control the speed of the movement device or a material penetration depth such that the sub-harmonic vibrations reach a predetermined value.

10. The device according to claim 1, wherein the measuring sensor for the translational vibrations comprises a three-axis acceleration sensor.

11. The device according to claim 1, wherein the measuring sensor for determining the rotational vibrations comprises direct-measuring absolute encoder assigned to the tool drum.

12. The device according to claim 11, wherein the direct-measuring absolute encoder comprises at least one of an inductive sensor and a Hall sensor.

13. The device according to claim 1, wherein the measuring sensor for determining the rotational vibrations comprises torque sensors assigned to the tool shafts.

14. A method for machining materials by milling and/or drilling, using a device having a tool drum mounted on a drum carrier and configured to rotate about a drum axis, in which a plurality of tool shafts driven in rotation by a drive element of a common gear drive are mounted, the tool shafts having machining tools at their ends projecting from the tool drum, the tool shafts rotating at a first rotational speed and the tool drum rotating at a second rotational speed, the drum carrier being movable relative to the material to be machined by a movement device, and a relative speed of the movement between the drum carrier and the material to be machined and a rotational speed of the tool drum and/or the tool shafts being configured to be varied by a control device, the method comprising:

measuring translational vibrations of the device with a first measuring sensor;

measuring rotational vibrations of the tool drum with a second measuring sensor;

determining a vibration spectrum by performing a vibration analysis on the measured translational and rotational vibrations;

determining sub-harmonic vibrations from the vibration spectrum; and controlling a speed of the movement device or a material penetration depth to decrease the sub-harmonic vibrations.

15. The method according to claim 14, comprising controlling the rotational speed and/or the relative speed based on the vibration spectrum such that harmonics reach a predetermined value in relation to a basic vibration.

16. The method according to claim 14, comprising determining non-linear sub-harmonic vibrations from the vibration spectrum, and controlling the rotational speed and/or the relative speed such that a ratio between the sub-harmonic vibrations and a basic vibration reaches a predetermined value.

* * * * *